US007047893B2

(12) United States Patent
Loving

(10) Patent No.: US 7,047,893 B2
(45) Date of Patent: May 23, 2006

(54) POLLUTION ABATEMENT INCINERATOR SYSTEM

(76) Inventor: Ronald E. Loving, 7740 W. Sunlark Way, Tucson, AZ (US) 85743

( * ) Notice: Subject to any disclaimer, the term of this patent is extended or adjusted under 35 U.S.C. 154(b) by 0 days.

(21) Appl. No.: 10/454,950

(22) Filed: Jun. 3, 2003

(65) Prior Publication Data

US 2004/0009443 A1 Jan. 15, 2004

Related U.S. Application Data

(60) Provisional application No. 60/384,684, filed on Jun. 3, 2002.

(51) Int. Cl.
*F23B 7/00* (2006.01)

(52) U.S. Cl. ..... 110/342; 110/210; 110/213

(58) Field of Classification Search ..... 431/5; 110/207, 210, 211, 212, 213, 214, 215
See application file for complete search history.

(56) References Cited

U.S. PATENT DOCUMENTS 4,213,935 A * 7/1980 Goodnight et al. ..... 422/111
4,630,553 A * 12/1986 Goetzman ..... 110/214
5,215,018 A * 6/1993 Sardari et al. ..... 110/235
5,320,523 A * 6/1994 Stark ..... 431/353
5,333,458 A * 8/1994 Loving ..... 60/722
5,337,567 A * 8/1994 Loving ..... 60/722
5,381,659 A * 1/1995 Loving et al. ..... 60/280
5,381,660 A * 1/1995 Loving et al. ..... 60/303
5,381,663 A * 1/1995 Loving ..... 60/722
5,572,866 A * 11/1996 Loving ..... 60/274
6,363,868 B1 * 4/2002 Boswell et al. ..... 110/213

* cited by examiner

*Primary Examiner*—Kenneth Rinehart

(57) ABSTRACT

As taught herein, an incinerator system that directly eliminates the undesirable and harmful pollution of any gases vented or exhausted to open air. The system utilizes a fuel injector system that is used to dispense gaseous or atomized fuel of almost any type and inject the fuel into the combustion chamber. The fuel injector system disperses the gaseous or atomized fuel within the combustion chamber. Once the gaseous or atomized fuel is in the combustion chamber, it is then ignited. A controller senses the operational parameters of the incinerator system to control fresh air, ignition and fuel supply to start the system and maintain proper operating temperatures within the incinerator system so as to optimize the combustion efficiency and energy economy of the pollution abatement incinerator system.

8 Claims, 3 Drawing Sheets

POLLUTION ABATEMENT INCINERATOR SYSTEM

RELATED APPLICATION

This application is derived from my provisional application No. 60/384,684, which was filed on Jun. 3, 2002 in the name of the current inventor. It is to be noted no new material has been entered. The application as presented herein has just been reformatted to comply with PTO regulations.

FIELD OF THE INVENTION

The present application relates in general to energy efficient systems that provide economical elimination of pollutants exhausted from a contained gaseous pollutant source but more particularly pertains to an apparatus and method of virtually eliminating or significantly reducing pollutants exhausted from piston and rotary type internal combustion engines and from other sources that produce pollutants through the combustion of petroleum or organic fuels.

BACKGROUND OF THE INVENTION

Reducing air pollution, particularly pollution from engine emissions and noxious odors from sources other than engine emissions, has become a strong environmental objective both in the United States and around the world. Because of worldwide tightening of pollution emission standards, inventors have continually tried to invent devices and methods that will meet these increasingly stringent standards. Many previous references that relate to methods and apparatus for incinerating hazardous materials and wastes, first trap particulates in a filtering device and then periodically burn the trapped particles to clean the filtering device, rather than continuously eliminating the particulates and other pollution. Other devices that attempt to directly eliminate pollution from exhaust using a combustion chamber fail to significantly reduce pollutants because the device itself produces large amounts of pollutants and may be energy inefficient.

There remains a need for a device that can continuously eliminate virtually all compounds such as oxides of nitrogen, hydrocarbons, carbon monoxide, odors and organic and inorganic particulates from pollution exhausted from a contained pollution source, including but not limited to combustion engines, restaurants, paint shops, bakeries, sewage processing plants, etc., and which also provides maximum energy efficiency.

SUMMARY OF THE INVENTION

The present invention overcomes the aforementioned problems by continuously eliminating virtually all pollution exhausted from a contained pollution source efficiently and inexpensively and is disclosed herein. The pollution abatement incinerator system causes pollution to be reduced to its base elements by the application of intense heat. The apparatus and method of use of the present invention, virtually eliminates pollution such as biological, hydrocarbons, particulates (such as carbon particles in the form of soot), and offensive odors while being energy efficient. This system, with minor modifications can be used to eliminate pollution from many different sources, including piston and rotary type internal combustion engines. The source of the pollutants can be an internal combustion engine such as, but not limited to those in cars, trucks, buses, boats and trains, but can also include pollution (including odors) emitted from devices that result in pollution of a gaseous flow other than combustion engines, such as, but not limited to, incinerators; restaurant and bakery stove exhaust; dry cleaners exhaust; automotive repair and paint shop exhaust; sewage treatment plant exhaust; power generating stations; and manufacturing facilities. The device is suitable for installation during original equipment manufacturing of the pollutant source (for example, during engine manufacturing and assembly process) and is also suitable for retrofit. In addition, when the pollution abatement incinerator system is attached to a host pollution source, there is no degradation of the host pollution source, no matter whether the pollution abatement incinerator system is turned on or off.

The double chambered pollution abatement incinerator system of the present invention includes combustion and incinerator chambers, a multi-fuel injection mechanism, an ignition mechanism, a fresh air blower mechanism and a controller mechanism along with other devices substantially as set forth in the specification.

In the present method, pollution in the form of exhausted gases is directed into the incinerator system where the undesirable and harmful compounds in the exhausted gas are virtually eliminated. When the correct amount of fuel and fresh air is added to the combustion chamber a primary turbulence zone is established, in this zone the mixture will ignite and burn with a blue flame shaped like a toroid just inside the combustion chamber. This blue flame indicates near total combustion of the fuel being injected into the chamber. The ignited fuel and air mixture in the center of the toroidal turbulence zone is kept in place by the velocity of the incoming fresh air and fuel as supplied. The flame in the center of the toroid turbulence produces heat that causes pollutants within the incinerator chamber to decompose to their natural elements. When polluted exhaust gases are injected into the incinerator chamber through a Venturi inlet pipe, a sudden expansion occurs at the inlet of the incinerator chamber as the gases enter into the larger diameter incinerator chamber. This sudden expansion will cause a round vortex primary turbulence zone to form inside the incinerator chamber.

A secondary turbulence zone within the incinerator chamber causes a turbulence flow from one end of the chamber to the other. This causes the heated gases to be retained in the elevated temperature of the incinerator chamber for a short period of time instead of being immediately exhausted through the output duct of the incinerator system. This delay or "dwell time" provides for more complete combustion and decomposition of the pollutants. The time period for removal of the pollutant material from the gaseous flow inside the incinerator chamber varies depending on the size of the incinerator chamber and the velocity of the gases to be disposed of.

These primary and secondary turbulence zones within the incinerator act to increase the energy efficiency of the incinerator chamber through the thorough mixing of fuel and fresh air making it more than 99% energy efficient in its ability to totally consume the fuel and produce heat. For effective, efficient and economical removal of pollutants from exhaust, the operating temperature within the incinerator should range from between about 500.degrees F. to about 2750.degrees F. At the proper operating temperatures, fewer oxides of nitrogen are formed and carbon-based compounds are reduced to their base elements. The selection of the most effective temperature for the virtual elimination of pollutants is dependent upon the type and concentration of pollutant exhaust.

The Double Chambered Pollution Abatement Incinerator System of the present invention is housed in a metal shell containing an insulated material to contain heat and thereby improve system efficiency and economy.

Recovery of heat energy from the combustion and incinerator chambers that would otherwise be thrown away is accomplished by circulating the pollution gases around the two chambers, within the outside longitudinal metal shell, before injecting the gases into the incinerator chamber through the Venturi inlet.

The blower mechanism is powered by a variable high speed electrical motor, capable of providing enough fresh air to sustain the combustion process within the combustion and incinerator chambers. The blower blows fresh air through the inlet air passageway disposed within the outer metal housing of the incinerator system and then into the combustion chamber first.

Recuperation takes place in the pollution gases passageway surrounding the longitudinal axis of the incinerator system between the housing of the combustion and incinerator chambers. Polluted air blown into the passageway is heated and directed to the venturi inlet of the incinerator chamber for final decomposition and destruction of polluting gases. This additional preheating of the pollution gases using the residual heat from the combustion and incinerator chamber results in less fuel required to raise the temperature of the pollution gases combustion process within the incinerator chamber resulting in less energy being expended to maintain the operating temperature of the incinerator system.

The liquid fuel injector system is a mechanical device used to convert any liquid fuel from a liquid to an atomized gaseous fuel prior to being injected into the combustion chamber. When the fuel to be used in the combustion chamber is already in a gaseous state the atomizer system is not needed. The fuel injector system is selectable between the two types if injectors depending on the fuel of choice.

The controller senses the operational parameters of the incinerator chamber by using one or more sensing devices. The controller monitors, via thermal, pressure and/or magnetic sensors, the operational characteristics of the combustion chamber. Also monitored are fuels used in the combustion process, the pressure of the combustion chamber, the pollution exhaust input to the system, and the fresh air input to the combustion chamber. It will also monitor the functioning of the high voltage ignition mechanism and the fuel supply. The controller controls the startup sequence by initializing the fuel injection system, then issuing instructions to the blower mechanism, ignition mechanism and the fuel supply to maintain the proper operating temperatures within the incinerator. Depending upon the load being exhausted into the incinerator chamber, the controller adjusts the input levels of fresh air from the blower mechanism and fuel from the fuel supply to maintain the proper operating temperature and pressures within the combustion chamber to sustain the operating condition of the incinerator chamber. In addition, at system startup and during system operation, the controller has the ability to run diagnostic routines on the Pollution Abatement Incinerator System to ensure its proper operation. These diagnostics may result in the identification of any problems within the Pollution Abatement Incinerator System.

The ignition system provides for initial ignition and startup of the combustion chamber. The ignition is composed of a glow plug, spark plug or similar device within the combustion chamber that is activated by the controller upon startup of the system. Once the combustion chamber is started, the controller unit turns off the ignition system. Ignition type can be a spark plug type, a glow plug ignition type device, or the like and associated electronic circuitry.

The pollution abatement incinerator system can be installed as a retrofit or add-on device to an existing pollution source, such as an automobile engine without degradation of the performance of the host system. The system is also suitable for manufacture as part of an original equipment manufacturing system, also without degradation of the host system. The device is suitable for installation on stationary and mobile sources of pollution and the device can use any type of fuel in a liquid or gaseous state.

DETAILED DESCRIPTION OF THE DRAWINGS

Figure 1:
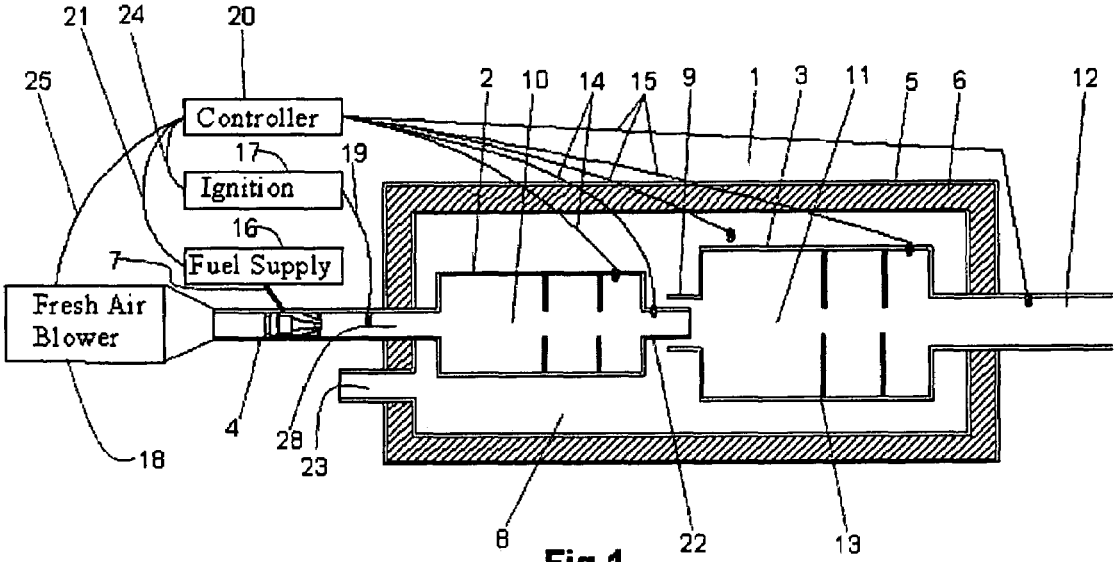
FIG. 1 is a diagrammatic representation of a sectional view of a preferred embodiment of the double chamber pollution abatement incinerator system.
Figure 2:
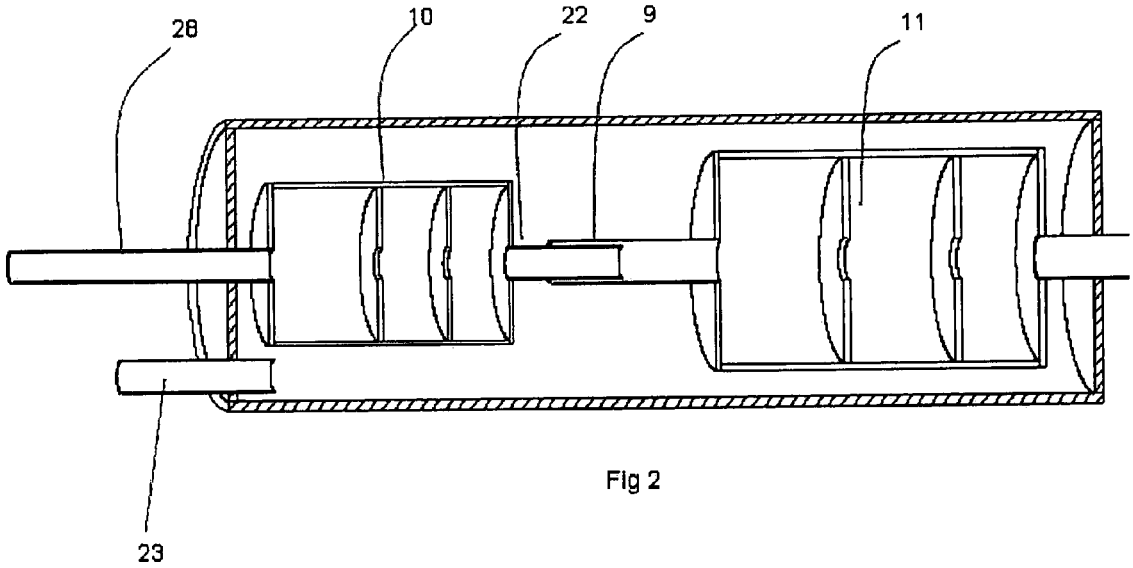
FIG. 2 is a diagrammatic representation of an isometric elevation of the first stage of the double chamber pollution abatement incinerator system

Turning now to FIG. 1, a preferred embodiment of the "Double Chambered Pollution Abatement Incinerator System" is shown in accordance with the present inventive concepts. The incinerator system has an outer housing 5 of metal material and an interior insulating layer 6 is disposed within outer housing 5. The combustion chamber 2 disposed within the housing 5 and spaced inward, is shown, which comprises a cylindrical shaped combustion chamber 10 for heating the system up to a temperature sufficient to eliminate virtually all pollutant material within the exhaust gases being digested or destroyed in the incinerator chamber 3. The incinerator chamber 3 disposed within the housing 5 and spaced inward, is shown, which comprises a cylindrical shaped incinerator chamber 11 for receiving the superheated gases from the cylindrical shaped combustion chamber 10 as well as the pollution gases being pulled in through the pollution venturi inlet 9. This will bring the temperature in the cylindrical shaped incinerator chamber 11 up to a temperature sufficient to eliminate virtually all pollutant material within the gases being digested or destroyed in the cylindrical shaped incinerator chamber 11. The cylindrical shaped incinerator chamber 11 having pollution venturi inlet duct 9 on the end facing the cylindrical shaped combustion chamber 10 and an exhaust outlet duct 12 on the opposite end of the cylindrical shaped incinerator chamber 11 to expel the virtually pollutant free exhaust. The incinerator chamber housing 13 is comprised of steel or a high temperature ceramic. There is a fuel input duct 7 coming in from the fuel supply 16. A first pressure sensor 14 is disposed within the combustion chamber 2 and a second pressure sensor 14 is disposed within combustion chamber exhaust output duct 22. A first temperature sensor 15 is disposed within the inside of incinerator system 8, a second temperature sensor 15 is disposed within the incinerator chamber housing 13 and a third temperature sensor 15 is disposed within exhaust outlet duct 12.

The fuel input duct 7 is connected between the fuel supply 16 and fuel injection system 4. The fuel supply 16 is connected to the controller 20 by a wire interface 21.

The controller 20 is connected to the temperature sensors 14 and the pressure sensors 15 within the combustion chamber, incinerator chamber 10 and the outer housing 5. The controller 20 is also connected to the ignition component 17 by the interface wire 24. The controller 20 is connected to the fresh air blower 18 by the interface wire 25.

The ignition component 17 is connected by a wire interface to a spark plug or glow plug 19 leading into the cylindrical shaped combustion chamber 10 and interfaces to the controller over wire 24.

The combustion chamber exhaust output duct 22 interfaces to the cylindrical shaped incinerator chamber 11 through the pollution venturi inlet duct 9 to the cylindrical shaped incinerator chamber 11. The opposite end of the cylindrical shaped incinerator chamber 11 exhausts the pollution free gases through exhaust outlet duct 12.

In practicing the present invention, power is first applied to the controller 20. The controller 20 will first start the ignition component 17 to produce the ignition spark or glow plug 19, then the fresh air blower 18 will be initialized and finally the fuel, gaseous or atomized liquid, will be injected into the cylindrical shaped combustion chamber 10 and ignited. The controller 20 will read the temperature sensors 14 within the cylindrical shaped combustion chamber 10, cylindrical shaped incinerator chamber 11 and the incinerator exhaust outlet duct 12. The gaseous or atomized liquid fuel is injected into the cylindrical shaped combustion chamber 10. When the cylindrical shaped combustion chamber 10 temperature has reached a certain temperature as indicated by the temperature sensors 14, the controller 20 may back off or slow down the input of fuel as required. Once the desired temperature is reached within the incinerator system 8, the controller 20 will maintain that temperature by controlling the fuel supply 16 and fresh air blown by the fresh air blower 18 to the cylindrical shaped combustion chamber 10.

Exhaust from a pollution source is input into the incinerator system 8 via the pollution input tube 23 once the incinerator system 8 reaches the proper temperature. It passes into the inside of the incinerator system 8. Once the pollution gases are inside the incinerator system 8, they are circulated around both the cylindrical shaped combustion chamber 10 and incinerator chamber 11 to recuperate excess or latent heat before being drawn into the pollution venturi inlet duct 9 of the incinerator chamber 11. As the pollution gases are drawn into the incinerator chamber 11 through the venturi inlet duct 9 they are mixed with the super heated exhaust from the cylindrical shaped combustion chamber 10 and the combustion process of the incinerator chamber 11 takes place.

Figure 3:
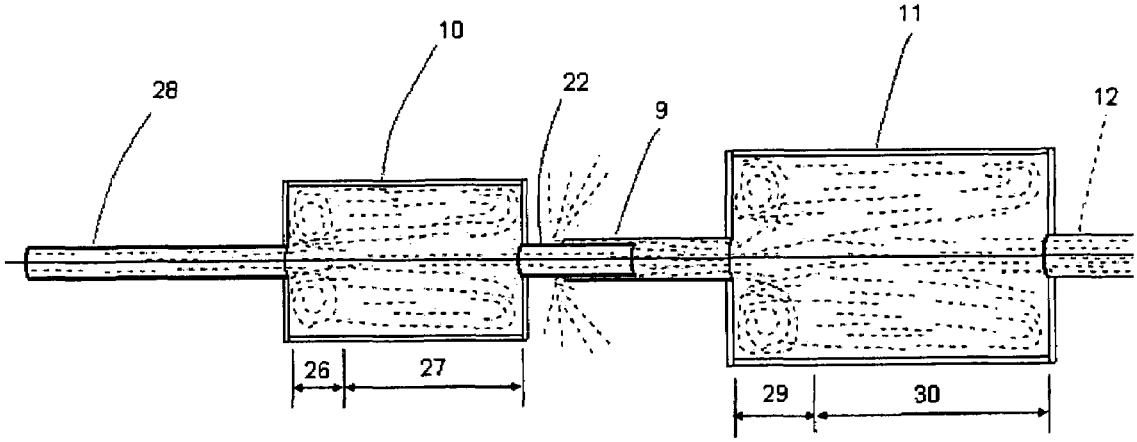
FIG. 3 is a diagrammatic representation of a side view of the incinerator showing the primary and secondary toroidal turbulence zones of the two chambers and the Venturi input system between the two chambers.

Turning now to FIG. 3 a sudden expansion occurs and causes a round vortex primary turbulence zone 26 to form just inside the cylindrical shaped combustion chamber 10. A secondary turbulence zone 27 is formed within the incinerator chamber 11. The heated gas is retained for a short time within the secondary turbulence zone 27 before being exhausted through to the incinerator chamber 11 through the pollution venturi inlet duct 9.

As the cylindrical shaped combustion chamber 10 comes up to temperature the super heated gases are expelled out through the combustion chamber exhaust output duct 22 past the venturi inlet duct 9 and on into the incinerator chamber 11. If any pollution gases are present at the venturi inlet duct 9 they will be pulled on into the incinerator chamber 11. As the gases from the cylindrical shaped combustion chamber 10 and the venturi inlet duct 9 converge at the input to the incinerator chamber 11 a sudden expansion occurs and causes a round vortex primary turbulence zone 29 to form just inside the incinerator chamber 11. A secondary turbulence zone 30 is formed within the incinerator chamber 11. The heated gas and pollution is retained for a short time within the secondary turbulence zone 30 and the pollution is destroyed before the resultant gases are exhausted out of the incinerator system 8 through the incinerator chambers exhaust outlet duct 12.

The controller 20 will sample the temperature sensors 14 and pressure sensors 15 within the cylindrical shaped combustion chamber 10 and incinerator chamber 11 and adjust the amount of fuel supply 16 and fresh air from the fresh air blower 18 to maintain the operating temperature of the cylindrical shaped combustion chamber 10 and incinerator chamber 11.

EXAMPLE

Over the past 12 years, actual combustion chambers and incinerator chambers have been built and successfully tested separately with astounding result on the pollution destruction capabilities of the systems. Computer math model analysis and physical experiments for the verification of the capability of the Pollution Abatement Incinerator System have been conducted. Math model analysis indicates that the pollution abatement incinerator system will reduce hydrocarbons to almost zero and indicate that carbon dioxide and nitrous oxides are controllable based on the temperatures in the chamber and the fuel use. The computer math model also indicates that the best results would be achieved by using diesel fuel with large amounts of air. Preliminary results of the physical testing of the incinerator chamber provide verification of the predictions of the math model. Using propane as the fuel for the chamber, a test was conducted to try to achieve the lowest hydrocarbon count possible. During the physical testing, a count of 4.4 parts per million of hydrocarbons was achieved along with an nitrous oxide count of 67 parts per million. During another test, a hydrocarbon count of 2.8 parts per million was achieved with a nitrous oxide count of 70.2 parts per million. Both tests were conducted with a 4-cylinder diesel engine running at 1100 rpm. The chamber used for the testing was about 4.5 inches diameter and about 12 inches in length Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

I claim:

1. A method of using a double chambered pollution abatement incinerator system, to continuously remove virtually all pollutants from a flow of a gaseous mixture, comprising the steps of:

a. forcing fresh air into an inlet duct of a combustion chamber;

b. injecting gaseous or atomized liquid fuel into said combustion chamber;

c. igniting a fuel and air mixture within said combustion chamber;

d. receiving exhaust from a pollution source into a pollution inlet duct of a pollution incinerator system;

e. heating an incinerator chamber to an operating temperature of between about 500 degrees to about 2750 degrees F., suddenly expanding said fuel and air mixture and exhaust to form a primary torus turbulence zone that results in a total combustion blue flame shaped like a toroid inside said combustion chamber adjacent to the fresh air inlet duct indicating that almost total combustion is occurring and a secondary turbulence zone flowing from one end of the combustion chamber to the opposite end, causing the heated gas to be retained for a short time in said combustion chamber before being expelled on into said incinerator chamber;

f. passing said exhaust from said combustion chamber to said incinerator chamber for a time sufficient to virtually eliminate all the undesirable and harmful compounds within said exhaust from a pollution source and then expelling said exhaust out of said incinerator system;

g. recovering heat from the exterior of the combustion and incinerator chambers to preheat the pollutants being forced into said incinerator chambers inlet duct; and h. sensing the temperature and a pressure within said incinerator and issuing instructions to a forced air mechanism, an ignition mechanism and a fuel injector to sustain proper operating temperatures within said incinerator.

2. The method of using a pollution abatement incinerator system according to claim 1, wherein the fuel injecting and igniting step comprises:

a. receiving said gaseous or liquid fuel into an atomizing injector disposed inside said input duct of said combustion chamber, dispersing and expelling said gaseous or said atomized liquid fuel into said combustion chamber; and b. connecting to a fuel supply line.

3. A double chambered pollution abatement incinerator system to continuously remove pollutants from a flow of a gaseous mixture, comprising:

a. a cylindrical shaped combustion chamber to produce proper temperatures, an incinerator chamber for heating exhaust gases to a temperature sufficient to eliminate virtually all pollutant material within said exhaust gases, said incinerator chamber having a pollution venturi inlet duct on one end which is smaller in diameter than an exhaust outlet duct on the opposite end of said incinerator chamber, said incinerator chamber having a pollution inlet duct on an end which is adjacent to said combustion chamber and larger in diameter than said combustion chambers outlet duct and an outlet mechanism on the opposite end of said incinerator chamber to expel the virtually pollutant free exhaust, the combustion chamber having an air intake inlet, a multi fuel injection system connected to a fuel line inlet, a fuel ignition mechanism, an air pressure sensor, and a temperature sensor, b. said combustion chamber of said incinerator system, when said fuel is ignited, contains a primary turbulence zone that results in a blue flame shaped like a toroid when a fuel air mixture is set correctly, adjacent to said inlet duct, said blue flame indicating that almost total combustion is occurring inside said combustion chamber, and a secondary turbulence zone flowing from one end of said incinerator to said opposite end, causing the heated gas to be retained for a short time in said combustion chamber before being expelled into said incinerator chamber;

c. said combustion chamber operates at a temperature of between about 600 degrees F. to about 2750 degrees F., depending on the pollution to be destroyed;

d. an area between said combustion chamber, said incinerator chamber and an outer longitudinal metal shell formed with an inner and outer surface area of said incinerator system acts as heat recuperation and pollution gases preheat area before pollution gases enter said incinerator chamber;

e. said fuel injection mechanism is connected to said fuel supply for injecting gaseous or atomized liquid fuel into said combustion chamber;

f. said ignition mechanism ignites said gaseous or atomized liquid fuel in said combustion chamber on initial system startup;

g. a fresh air supply mechanism; and h. a controller which senses the air pressure and temperature within said combustion chamber and issues commands to said fresh air supply mechanism, said fuel injector and said ignition mechanism initialize and maintain proper operating temperatures within said combustion chamber.

4. The double chambered pollution abatement incinerator system according to claim 3, wherein said incinerator system maintains a constant temperature within said incinerator system, thereby maximizing the pollution abatement process and the fuel efficiency of said incinerator system.

5. The double chambered pollution abatement incinerator system according to claim 4, wherein said incinerator system further includes an outer longitudinal metal shell for containment of said combustion chamber and said incinerator chamber within.

6. The double chambered pollution abatement incinerator system according to claim 3, whereby in order to recover heat from said combustion chamber and said incinerator chamber, input pollution gases are circulated within said outer longitudinal metal shell and around metal shells of the chambers wherein heat is transferred through an inner surface of said combustion and incinerator chambers metal shell to an outer surface of said metal shell and said pollution gases are then heated by this process.

7. The pollution abatement incinerator system according to claim 3, further comprising combustion and incinerator chambers having no moving parts.

8. A pollution abatement incinerator system kit to continuously remove pollutants from a flow of a gaseous mixture, comprising:

a. a cylindrical shaped incinerator system with two chambers, one of said two chambers being a combustion chamber for bringing said system up to a correct temperature to sufficiently eliminate virtually all pollutant material and compounds within pollution gases, the other one of said two chambers being an incinerator chamber having a pollution inlet duct on an end which connects to said combustion chamber and which is larger in diameter than an output duct of said combustion chamber, thus makes a venturi inlet valve system to draw said pollution gases into said incinerator chamber for destruction, an outlet duct on an opposite end of said incinerator chamber is used to expel said virtually pollutant free exhaust, said combustion chamber having an air intake inlet, a fuel injection system connected to a fuel line inlet, a fuel ignition mechanism, a fuel pressure sensor, and a temperature sensor;

b. said combustion chamber, when said fuel and air are ignited, contains a primary torus turbulence zone that results in a blue flame shaped like a toroid adjacent to said combustion chamber inlet duct, said blue flame indicating that almost total combustion is occurring inside said combustion chamber, and a secondary turbulence zone flowing from one end of said incinerator chamber to an opposite end, thus causing said heated gas to be retained for a short time in said combustion chamber before being expelled into said incinerator chamber;

c. said incinerator chamber operates at a temperature of between about 500 degrees to about 2750 degrees F.;

d. an ignition mechanism which ignites gaseous or atomized liquid fuel in said combustion chamber on initial system startup;

e. a fresh air supply mechanism; and f. a controller which senses a pressure and temperature within said incinerator chamber and issues commands to said fresh air supply mechanism, said fuel injector and said ignition mechanism to initialize and maintain proper operating temperatures within said incinerator chamber.

* * * * *